US006397907B1

(12) United States Patent
Heintz

(10) Patent No.: US 6,397,907 B1
(45) Date of Patent: Jun. 4, 2002

(54) TELESCOPING FUNNEL APPARATUS

(76) Inventor: John E. Heintz, 5084 Tisdale Way, San Jose, CA (US) 95130

( * ) Notice: Subject to any disclaimer, the term of this patent is extended or adjusted under 35 U.S.C. 154(b) by 0 days.

(21) Appl. No.: 09/917,157

(22) Filed: Jul. 27, 2001

(51) Int. Cl.[7] ..... B65B 39/00; B67C 11/04

(52) U.S. Cl. ..... 141/338; 141/331; 141/337; 141/340; 141/388; 141/391

(58) Field of Search ..... 141/331–345, 141/98, 311 R, 312, 388, 391, 383, 384; D12/197, 317; 220/86.1, 86.2, 288

(56) References Cited

U.S. PATENT DOCUMENTS 1,510,631 A * 10/1924 Nutry ..... 141/338
4,703,867 A 11/1987 Schoenhard
5,033,521 A 7/1991 Martin
5,188,157 A 2/1993 Lee
5,195,567 A * 3/1993 Tyree, Jr. ..... 141/331
D350,969 S 9/1994 Chrisco
5,535,793 A 7/1996 Tantre
D403,642 S * 1/1999 Acord ..... D12/197
5,979,516 A 11/1999 Grant

* cited by examiner

*Primary Examiner*—Timothy L. Maust

(57) ABSTRACT

A telescoping funnel apparatus for directing fluid from a container. The telescoping funnel apparatus includes a funnel that includes an open top extending into a channel. The channel extends through an open bottom of the funnel allowing fluid to be directed through the funnel. A longitudinal axis of the funnel extends between the open top and bottom. A cover is provided for selectively closing the open top of the funnel.

10 Claims, 2 Drawing Sheets

TELESCOPING FUNNEL APPARATUS

BACKGROUND OF THE INVENTION

1. Field of the Invention

The present invention relates to funnels and more particularly pertains to a new telescoping funnel apparatus for directing fluid from a container.

2. Description of the Prior Art

The use of funnels is known in the prior art. More specifically, funnels heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,033,521; U.S. Pat. No. 5,188,157; U.S. Pat. No. 5,535,793; U.S. Pat. No. 4,703,867; U.S. Pat. No. 5,979,516; and U.S. Pat. No. Des. 350,969.

While these devices fulfill their respective, particular objectives and requirements, the aforementioned patents do not disclose a new telescoping funnel apparatus. The inventive device includes a funnel that includes an open top extending into a channel. The channel extends through an open bottom of the funnel allowing fluid to be directed through the funnel. A longitudinal axis of the funnel extends between the open top and bottom. A cover is provided for selectively closing the open top of the funnel.

In these respects, the telescoping funnel apparatus according to the present invention substantially departs from the conventional concepts and designs of the prior art, and in so doing provides an apparatus primarily developed for the purpose of directing fluid from a container.

SUMMARY OF THE INVENTION

In view of the foregoing disadvantages inherent in the known types of funnels now present in the prior art, the present invention provides a new telescoping funnel apparatus construction wherein the same can be utilized for directing fluid from a container.

The general purpose of the present invention, which will be described subsequently in greater detail, is to provide a new telescoping funnel apparatus apparatus and method which has many of the advantages of the funnels mentioned heretofore and many novel features that result in a new telescoping funnel apparatus which is not anticipated, rendered obvious, suggested, or even implied by any of the prior art funnels, either alone or in any combination thereof.

To attain this, the present invention generally comprises a funnel that includes an open top extending into a channel. The channel extends through an open bottom of the funnel allowing fluid to be directed through the funnel. A longitudinal axis of the funnel extends between the open top and bottom. A cover is provided for selectively closing the open top of the funnel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new telescoping funnel apparatus apparatus and method which has many of the advantages of the funnels mentioned heretofore and many novel features that result in a new telescoping funnel apparatus which is not anticipated, rendered obvious, suggested, or even implied by any of the prior art funnels, either alone or in any combination thereof.

It is another object of the present invention to provide a new telescoping funnel apparatus which may be easily and efficiently manufactured and marketed.

It is a further object of the present invention to provide a new telescoping funnel apparatus which is of a durable and reliable construction.

An even further object of the present invention is to provide a new telescoping funnel apparatus which is susceptible of a low cost of manufacture with regard to both materials and labor, and which accordingly is then susceptible of low prices of sale to the consuming public, thereby making such telescoping funnel apparatus economically available to the buying public.

Still yet another object of the present invention is to provide new telescoping funnel apparatus which provides in the apparatuses and methods of the prior art some of the advantages thereof, while simultaneously overcoming some of the disadvantages normally associated therewith.

Still another object of the present invention is to provide a new telescoping funnel apparatus for directing fluid from a container.

Yet another object of the present invention is to provide a new telescoping funnel apparatus which includes a funnel that includes an open top extending into a channel. The channel extends through an open bottom of the funnel allowing fluid to be directed through the funnel. A longitudinal axis of the funnel extends between the open top and bottom. A cover is provided for selectively closing the open top of the funnel.

Still yet another object of the present invention is to provide a new telescoping funnel apparatus that prevents fluid from being spilled on the engine.

Even still another object of the present invention is to provide a new telescoping funnel apparatus that is securable to the engine, thereby reducing the frustration of a user having to search for a funnel to place fluid in the engine.

These together with other objects of the invention, along with he various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
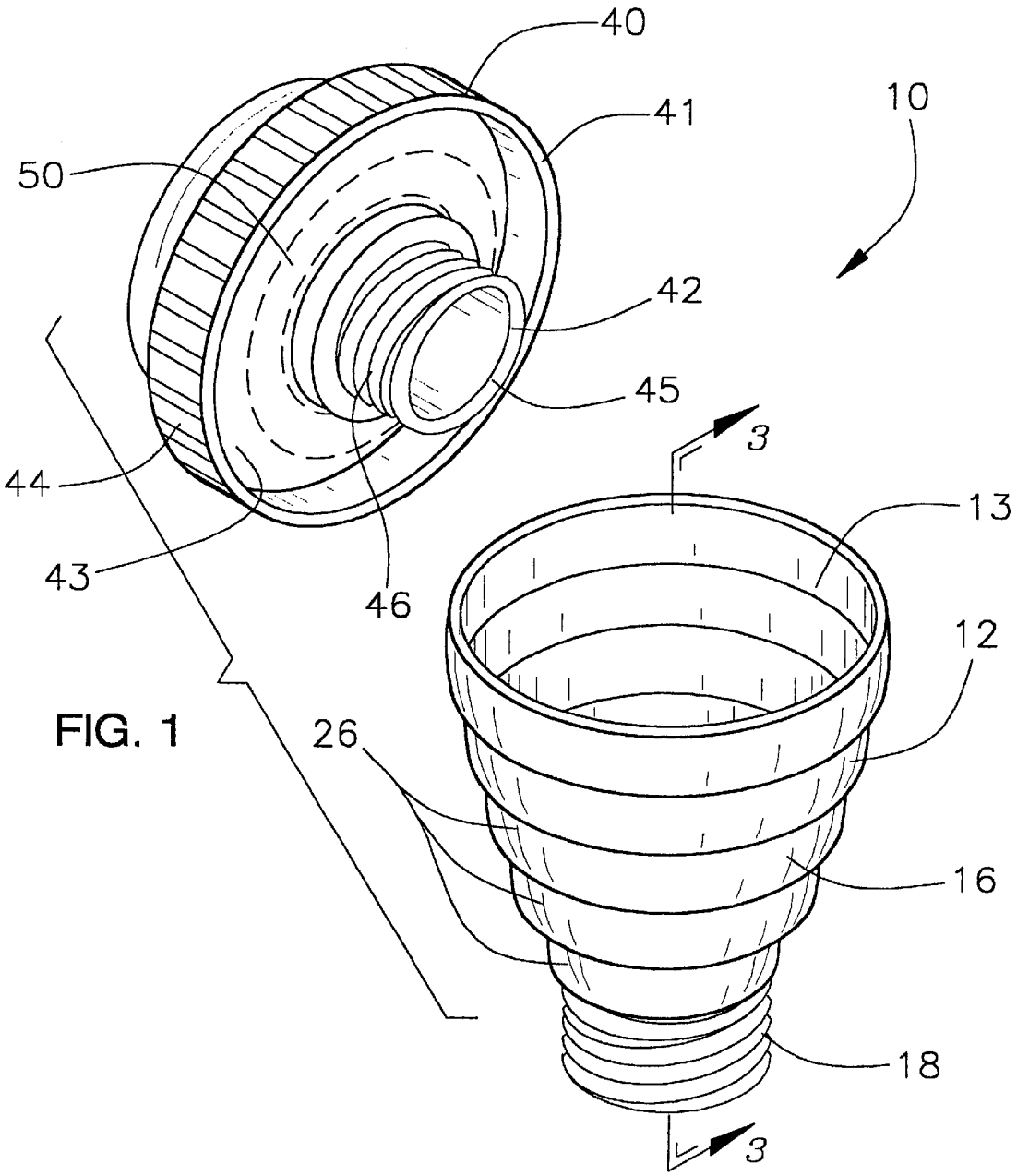
FIG. 1 is a schematic perspective view of a new telescoping funnel apparatus according to the present invention.
Figure 2:
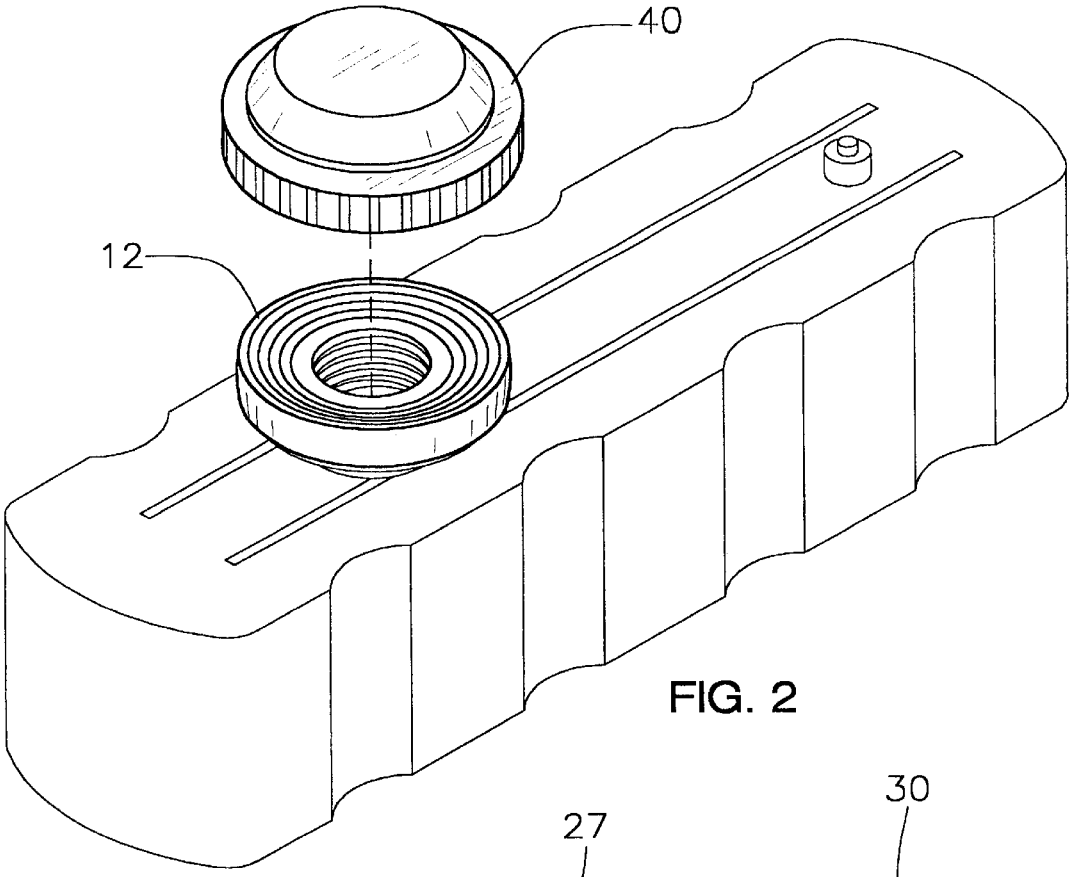
FIG. 2 is a perspective view of the present invention.
Figure 3:
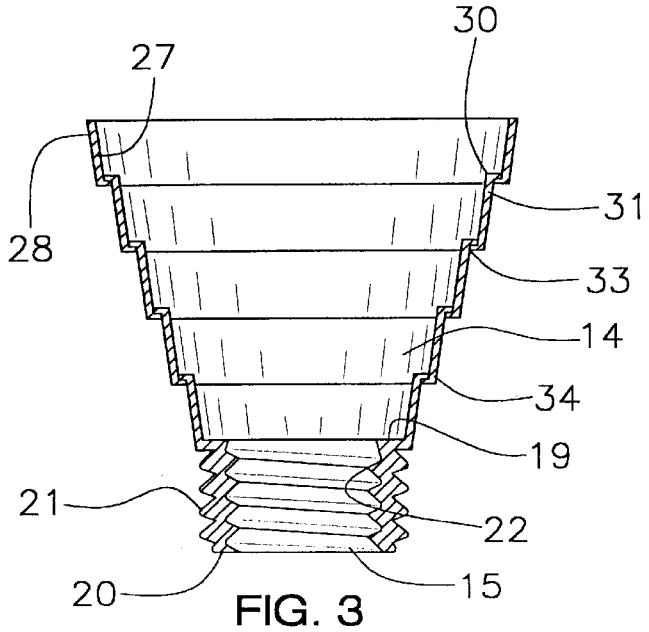
FIG. 3 is a perspective view of the present invention taken along line 3—3 of FIG. 1.

With reference now to the drawings, and in particular to FIGS. 1 through 3 thereof, a new telescoping funnel apparatus embodying the principles and concepts of the present invention and generally designated by the reference numeral 10 will be described.

As best illustrated in FIGS. 1 through 3, the telescoping funnel apparatus 10 generally comprises a funnel 12 that includes an open top 13 extending into a channel 14 which extends through an open bottom 15 of the funnel 12. A longitudinal axis of the funnel 12 extends between the open top 13 and open bottom 15. The funnel 12 may have a length measuring approximately six inches between the open top 13 and bottom 15. The funnel 12 may measure approximately two to four inches in width.

The funnel 12 may include a funnel portion 16 and a securing portion 18. The securing portion 16 may comprise a generally cylindrical member that includes a first end 19, a second end 20, an outer surface 21 and an inner surface 22. The outer surface 21 of the securing portion 16 may be threaded for permitting threaded coupling to the oil inlet in the valve cover.

The funnel portion 16 may include a plurality of annular members 26 that are selectively coupled together such that the funnel portion 16 is collapsible. Each of the annular members 26 includes an inner surface 27 and an outer surface 28. Each of the annular members 26 may include an outer annular lip 30 extending away from the outer surface 28 of each of the annular members 26. Each of the outer annular lips 30 is preferably positioned generally adjacent to a first end 31 of each of the annular members 26.

Each of the annular members 26 may include an inner annular lip 33 extending away from the inner surface 27 of each of the annular members 26. The inner annular lips 33 of each of the annular members 26 is preferably positioned generally adjacent to a second end 34 of each of the annular members 26. One of the inner annular lips 33 of the annular members 26 may be mounted on the first end 19 of the securing portion 18 connecting the funnel portion 16 to the securing portion 18.

Each of the annular members 26 includes a diameter that is greater than the diameter of an adjacent annular member 26 such that the diameters of the annular members 26 decrease from the open top 13 of the funnel 20 toward the open bottom 15.

The funnel portion 16 may telescope between an extended position and a retracted position. In one embodiment of the present invention, the extended position is characterized by the outer annular lips 30 and the inner annular lips 33 of adjacent annular members 26 selectively abutting each other. The retracted position is characterized by each of the annular members 26 lying generally within another of the annular members 26.

The outer surface 28 of each of the annular members 26 may include a generally arcuate shape such that each of the inner annular lips 33 selectively abuts the outer surface 28 of an adjacent annular member 26 keeping the funnel portion 16 in the extended position. Each of the annular members 26 may comprise a generally flexible material such as, for example, a plastic, nylon or aluminum material. The funnel 12 preferably comprises a material having a high melting point since it may be securable to the engine.

A cover 40 is provided for selectively closing the open top 13 of the funnel 12 when the funnel portion 16 is in the retracted position. The cover 40 may include a cap portion 41 and a securing portion 42. The cap portion 41 may include wall 43 and a perimeter member 44 extending away from the wall 43. The securing portion 42 may comprise a generally cylindrical member 45 that is mounted on a central portion of the wall 43.

The cylindrical member 45 is removably insertable in the channel 14 extending through of the funnel 12. An outer surface 46 of the securing portion 42 may be threaded for threaded coupling to the inner surface 22 of the securing portion 18 of said funnel 12. The cylindrical member 45 is preferably orientated generally parallel to the peripheral member 44 of the cap portion 41.

A seal 50 may be provided. for preventing movement of fluid through the funnel 12 when it is in the retracted position. The seal 50 may be mounted on the wall 43 of the cap portion 41 of the cover 40 and may be positioned generally about the cylindrical member 45. In one embodiment of the present invention, the first end 19 of the securing portion 18 of the funnel 12 selectively abuts the seal 5 when the cover 40 selectively blocks the open top 13 of the funnel 12.

In use, the securing portion 18 of the funnel 12 is threaded into the inlet of the valve cover of the engine. Once the funnel 12 is threaded in the inlet of the valve cover, the funnel portion 16 may be moved into the extended position to direct fluid into the inlet of the valve cover. Once the fluid is directed into the inlet of the valve cover, the funnel portion 16 of the funnel 12 may be moved from the extended position to the retracted position. The cover 40 may then be threadedly coupled to the securing portion 18 of the funnel 12 for blocking the open top 13 of the funnel 12 while the funnel 12 is not being used.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A telescoping funnel apparatus for selectively directing fluid from a container, said device comprising:

a funnel having an open top extending into a channel, said channel extending through an open bottom of said funnel, and a longitudinal axis extending between said open top and bottom;

a cover for selectively closing said open top of said funnel;

a seal for preventing movement of fluid through said open top in said funnel, said seal being mounted on said cover;

wherein said funnel has a funnel portion and a securing portion, said securing portion comprising a generally cylindrical member having an outer surface;

wherein said outer surface of said securing portion is threaded for permitting threaded coupling to an oil inlet in a valve cover of an engine;

wherein said funnel portion includes a plurality of annular members being selectively coupled together such that said funnel portion is collapsible; and wherein each of said annular members has a diameter, said diameter of each of said annular members being greater than said diameter of an adjacent said annular member such that said diameters of said annular members decrease from said open top of said funnel toward said open bottom.

2. The telescoping funnel apparatus of claim 1, wherein each of said annular members has an outer annular lip extending away from an outer surface of each of said annular members, each of said annular members having an inner annular lip extending away from an inner surface of each of said annular members, said inner and said outer annular lips of adjacent said annular members selectively engaging each other.

3. The telescoping funnel apparatus of claim 2, wherein said funnel portion telescopes between an extended position and a retracted position.

4. The telescoping funnel apparatus of claim 3, wherein said extended position is characterized by said outer annular lips and said inner annular lips of adjacent annular members selectively engaging, wherein said retracted position is characterized by each of said annular members lying generally within another of said annular members.

5. The telescoping funnel apparatus of claim 4, wherein said outer surface of each of said annular members has a generally arcuate shape such that each of said inner annular lips selectively abuts said outer surface of an adjacent annular member for keeping said funnel in said extended position.

6. The telescoping funnel apparatus of claim 1, wherein said cover has a cap portion and a securing portion.

7. The telescoping funnel apparatus of claim 6, wherein said cap portion has wall and a perimeter member extending away from said wall, said securing portion comprising a generally cylindrical member mounted on a central portion of said wall.

8. The telescoping funnel apparatus of claim 7, wherein said cylindrical member is removably inserted in said open top of said funnel.

9. The telescoping funnel apparatus of claim 1, wherein said seal comprises a resiliently flexible material.

10. A telescoping funnel apparatus for selectively directing fluid from a container into an engine, the engine including a valve cover having an oil inlet port extending into the engine, said device comprising:

a funnel having an open top and an open bottom, said funnel having channel extending into through an open bottom of said funnel, and a longitudinal axis extending between said open top and bottom;

said funnel having a funnel portion and a securing portion;

said securing portion comprising a generally cylindrical member having a first end, a second end, an outer surface and an inner surface;

said second end of said securing member being removably insertable in the oil inlet of the valve cover of the engine;

said outer surface of said securing portion being threaded for permitting threaded coupling to the oil inlet in the valve cover;

said funnel portion including a plurality of annular members being selectively coupled together such that said funnel portion is collapsible, each of said annular members having an inner surface and an outer surface, each of said annular members having an outer annular lip extending away from said outer surface of each of said annular members, each of said outer annular lips being positioned generally adjacent to a first end of each of said annular members, each of said annular members having an inner annular lip extending away from said inner surface of each of said annular members, said inner annular lips of each of said annular members being positioned generally adjacent to a second end of each of said annular members, said inner annular lip of said annular member positioned generally adjacent to said second end of said funnel portion being mounted on said first end of said securing portion, each of said annular members having a diameter;

said diameter of each of said annular members being greater than said diameter of an adjacent annular member such that said diameters of said annular members decreases from said open top of said funnel toward said open bottom;

said plurality of annular members comprising a generally flexible material said funnel portion telescoping between an extended position and a retracted position;

wherein said extended position is characterized by said outer annular lips and said inner lips of adjacent annular member selectively engaging;

wherein said retracted position is characterized by each of said annular members lying generally within another of said annular members;

said outer surface of each of said annular members having a generally arcuate shape such that said inner annular lips selectively abuts said outer surface of an adjacent annular member for keeping said funnel in said extended position a cover for selectively closing said open top of said funnel when said funnel portion is in said retracted position;

said cover including a cap portion having a wall and a perimeter member extending away from said wall;

said cover being removably coupled to said funnel such that said wall of said cover selectively blocks said open top;

said cover including a securing portion having a generally cylindrical member mounted on a central portion of said wall of said cover, said securing portion having an inner surface and an outer surface;

said cylindrical member being removably inserted in said securing portion of said funnel when said cover selectively covers said open top of said funnel;

said outer surface of said securing portion being threaded for being threadedly coupled to said inner surface of said securing portion of said funnel said cylindrical member being orientated generally parallel to said perimeter member of said cover;

a seal for preventing movement of fluid through the inlet port of the valve cover, said seal being mounted on said wall of said cap portion of said cover and positioned generally about said cylindrical member;

wherein said first end of said securing portion of said funnel selectively abuts said seal when said cover selectively blocks said open top of said funnel; and said seal comprising a resiliently flexible material.

* * * * *